United States Patent [19]

Byram et al.

[11] Patent Number: 4,659,298

[45] Date of Patent: Apr. 21, 1987

[54] PUMP WITH VANE ACTUATING SYSTEM

[75] Inventors: Alfred A. Byram, Edmond; Willie Wystemp, Oklahoma City, both of Okla.

[73] Assignee: Corken International Corporation, Oklahoma City, Okla.

[21] Appl. No.: 734,406

[22] Filed: May 14, 1985

[51] Int. Cl.[4] ..... F04C 18/00

[52] U.S. Cl. ..... 418/253; 418/257; 418/258

[58] Field of Search ..... 418/253-258, 418/70, 266-268

[56] References Cited

U.S. PATENT DOCUMENTS

| | | | |
|---|---|---|---|
| 104,950 | 7/1870 | Fuller | 418/266 |
| 582,280 | 5/1897 | Goodwin et al. | 418/258 |
| 753,086 | 2/1904 | Mains | 123/201 |
| 1,422,946 | 7/1922 | Egersdorfer | 418/257 |
| 1,769,647 | 7/1930 | Press | 418/216 |
| 1,913,758 | 6/1933 | Hapkins | 418/266 |
| 2,541,405 | 2/1951 | Chapman | 418/266 |
| 2,688,924 | 9/1954 | Links | 417/204 |
| 2,899,941 | 8/1959 | Adams | 417/301 |
| 3,045,899 | 7/1962 | Maher | 418/258 |
| 3,076,414 | 2/1963 | Adams | 418/133 |
| 3,391,678 | 7/1968 | Luckhardt | 123/204 |
| 3,498,186 | 3/1970 | Northcutt | 418/152 |
| 3,820,924 | 6/1974 | Cassidy | 418/267 |

*Primary Examiner*—Carlton R. Croyle
*Assistant Examiner*—Jane E. Obee
*Attorney, Agent, or Firm*—Neal R. Kennedy

[57] ABSTRACT

A sliding vane positive displacement pump with a spring biased mechanical vane actuating system. The pump includes a case having an inlet and an outlet with a liner having a cam-shaped inner surface eccentrically disposed therein. A rotor having radially oriented slots is rotatably positioned within the case, and radial holes interconnect opposite pairs of slots. A vane is slidingly positioned in each slot. A vane actuator assembly, including a hollow sleeve with a plunger reciprocably disposed therein, is installed in each slot. A spring is positioned in the sleeve and bears against one end of the plunger and a closed end of the sleeve. The spring biases the sleeve and plunger so that each is in contact with the inwardmost edge of a vane. Each plunger defines a slot therein, and each sleeve defines a transverse hole therethrough corresponding to the slot. A pin, pressed into the transverse hole, extends through the slot for preventing the plunger and sleeve from becoming separated. The sleeve also defines pressure relieving holes so that as the plunger moves toward the sleeve, pressure in the sleeve is relieved.

8 Claims, 5 Drawing Figures

PUMP WITH VANE ACTUATING SYSTEM

BACKGROUND OF THE INVENTION

1. Field of the Invention

This invention relates to sliding vane positive displacement pumps, and more particularly to such a pump having a spring biased mechanical vane actuating system.

2. Description of the Prior Art

One of the primary concerns in using positive displacement pumps of the sliding vane type is maintaining the vanes in contact with the inner surface of a liner along which the vanes ideally move in transporting liquids through the pump. As is known to those skilled in the art, there is natural centrifugal force acting outwardly on the vanes as the rotor rotates. However, in many applications, and particularly with fluids of high specific gravity or high viscosity, the vanes will lift from the inner surface, and thus fluid will slip by the vanes. The result is a decrease in pumping efficiency. Many means have been devised to place additional outwardly acting forces on the vanes in addition to the centrifugal force so that the vanes will track the inner surface properly for maintaining higher efficiency.

In one method, holes are drilled through the rotor interconnecting opposite pairs of vanes. A solid pin is slidingly positioned in the hole such that as one vane moves inwardly, the opposite vane is forced outwardly. A problem with such a system is that the dimension across the liner may not be constant. If this is the case, the pin must be somewhat shorter than the normal distance between the two innermost edges of the opposite vanes. Even if the distance across the liner is constant, the solid pin arrangement allows no compensation for wear on the outer edges of the vanes. In either case, the result is that the pin has some movement between the vanes and is not maintained in constant contact with the inner edges thereof. The pin is thus bounced back and forth between the vanes as the rotor turns. In other words, the pin impacts the inner surface of each of the opposite vanes for each revolution of the rotor. At the high speeds with which positive displacement pumps may be operated, the force of impact of the pin on the vanes can be quite high, quickly resulting in damage to the vanes. One solution has been the use of hard metal bumpers attached to the vanes to protect the inner surface. The result is an expensive vane, and the pins will eventually wear the bumpers as well.

Another method of providing outward force on vanes for sliding vane pumps is the use of a coil spring positioned between the inner surface of the vane and the rotor slot. One such arrangement is shown in U.S. Pat. No. 2,541,405 to Chapman, in which a hole is countersunk in each vane to contain and guide the spring. In the fluid motor of Adams, U.S. Pat. No. 2,899,941, both the rotor and the vanes have countersunk holes. There are many variations on the spring actuated vane arrangement. This system has the advantage of compensating for wear on the outer surface of the vanes, but a frequent problem is wear on the outer surfaces of the spring. Also, countersinking holes in the vanes results in a weakness which is frequently unacceptable in modern pumps which utilize plastic materials for the vanes. Because the springs are not totally contained, there is the possiblity that they may be skewed slightly which could have a detrimental effect on blade actuation.

Another solution has been the use of two pins disposed in a hole intercommunicating two opposite slots with a spring positioned therebetween. This arrangement contains the spring sufficiently so that it will not skew, but still has the disadvantage of wear on the outer surfaces of the spring because the spring must slide in the hole in the rotor along with the pins. Another disadvantage of the multiple pin and spring arrangement is that the pins and springs must be installed separately.

The vane actuating system of the present invention has the advantages of spring actuation to help compensate for vane wear, and also has the advantage over the prior art of totally containing the spring such that the spring does not slide back and forth in the hole in the rotor. Thus, the wear life on the spring is greatly increased. Also, in the vane actuating system of the present invention, a retainer pin is used so that the assembly can be installed in the pump as one piece, so there are no loose parts.

SUMMARY OF THE INVENTION

The pump with vane actuating system of the present invention utilizes a housing or case having an inlet and the outlet with a liner having a cam-shaped inner surface eccentrically disposed within the housing. Preferably, this liner is removable from the housing. A rotor having a plurality of substantially radially oriented slots therein is rotatably disposed within the housing and has an outside diametric surface in close, spaced relationship with a portion of the cam-shaped inner surface of the liner. A vane is slidingly positioned in each of the slots such that an outer edge of the vane is engageable with the cam-shaped inner surface. The rotor defines a plurality of radial holes therein, each hole being in communication with the inwardmost surface of a slot. Preferably, an even number of such slots are equally angularly spaced around the rotor so that each slot has a corresponding opposite slot, and a hole interconnects each pair of slots.

A vane actuator assembly is disposed in each of the holes, and each vane actuator assembly comprises a hollow sleeve portion defining a cavity with an open end and a closed end, a plunger portion slidably disposed in, and dimensioned to conform to, the cavity, and a spring disposed in the sleeve portion and bearing aainst one end of the plunger portion and against the closed end of the sleeve portion for oppositely biasing the sleeve and plunger portions. When the vane actuator assemblies are in an operating position in the holes in the rotor, the closed end of the sleeve portion or the end of the plunger portion opposite the end disposed in the sleeve portion is engaged with an inward edge of a corresponding vane such that the vane is radially outwardly biased toward the cam-shaped inner surface as the rotor rotates within the case. In the preferred embodiment, as one vane is forced inwardly by the cam-shaped inner surface, this force is transmitted through the vane actuator assembly to an opposite vane, thus forcing it outwardly.

The vane actuating apparatus further comprises means for limiting the relative opposite movement between the sleeve and plunger portions in that the plunger portion defines a slot therethrough longitudinal with an axis thereof, and the sleeve portion defines a transverse hole therethrough correpsonding to the slot in the plunger portion. A pin is positioned in the transverse hole in the sleeve portion, and the pin extends into the slot in the plunger portion, and is slidable therewith.

By proper location of the hole and the slot, the spring can be maintained in compression so that one end of the slot is in contact with the pin when the vane actuator assembly is not installed in the pump. The vane actuator assembly is sized such that when placed in an operating position between vanes, the spring is further compressed so that the pin is no longer in contact with one end of the slot, and the sleeve portion covers the slot in the plunger portion. At least one hole is provided in the sleeve portion as a pressure relieving means which allows fluid trapped in the cavity to escape therefrom as the plunger portion is moved toward the sleeve portion.

One object of the present invention is to provide a vane actuating system for maintaining vanes in a sliding vane pump in contact with an inner surface of the pump.

Another object of the invention is to provide a system for spring actuating vanes in a sliding vane pump in which the spring is totally enclosed and has no sliding contact with the pump rotor or vanes.

A further object of the present invention is to provide a sliding vane pump having a plurality of opposite pairs of vanes with a spring biased vane actuating system for the vanes.

Still another object of the invention is to provide a vane actuator assembly having a hollow sleeve portion with a plunger portion reciprocably disposed therein and having a spring positioned between the plunger and sleeve portions to oppositely bias the portions.

Additional objects and advantages of the invention will become apparent as the following detailed description of the preferred embodiment is read in conjunction with the accompanying drawings which illustrate such preferred embodiment.

DETAILED DESCRIPTION OF THE PREFERRED EMBODIMENTS

Figure 1:
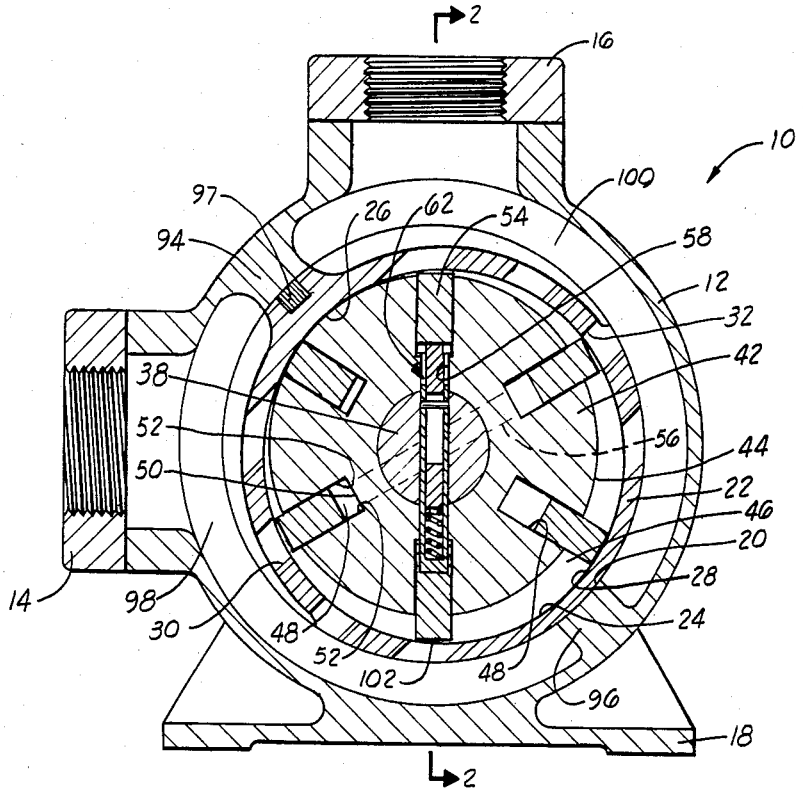
FIG. 1 shows a cross-sectional view of a sliding vane pump with vane actuating system of the present invention taken perpendicular to an axis of rotation as indicated by line 1—1 in FIG. 2.
Figure 2:
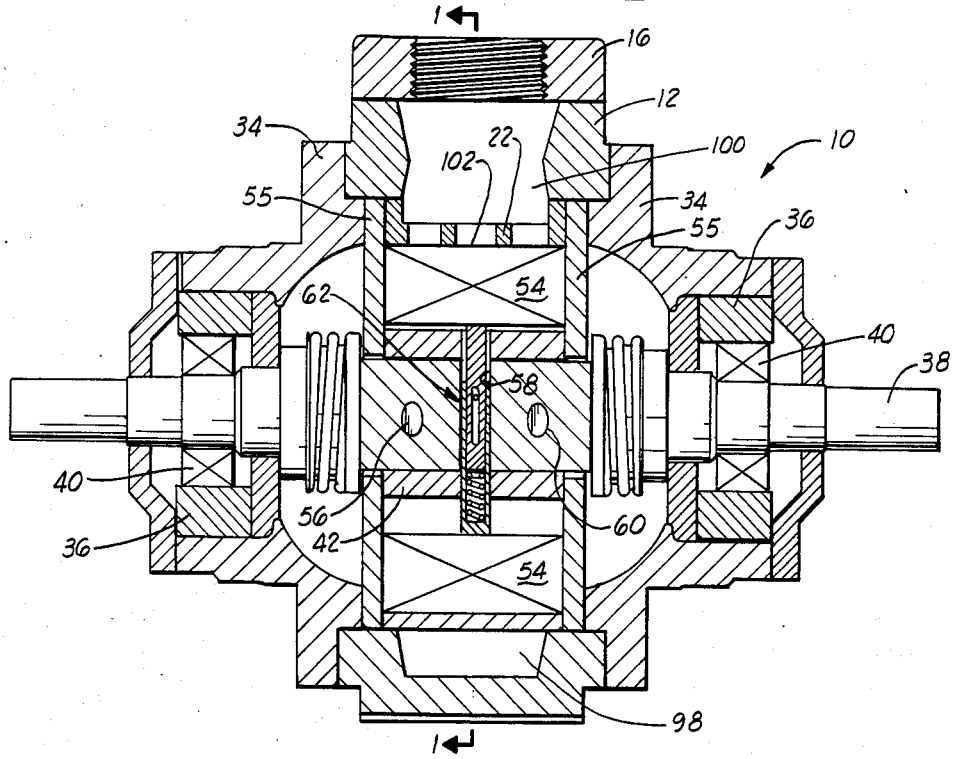
FIG. 2 shows a longitudinal cross-section taken along line 2—2 in FIG. 1.

Referring now to the drawings, and more particularly, to FIGS. 1 and 2, a pump with the vane actuating system of the present invention is shown and generally designed by the numeral 10. The pump includes an outer housing or case 12 having an inlet flange 14 and an outlet flange 16 attached thereto. Preferably, case 12 also includes integral mounting feet 18. Case 12 defines a substantially circular inside diameter 20 in which is positioned a liner 22. In the embodiment shown in the drawings, line 22 is separable from case 12, but in an alternate embodiment, the liner could be integral with the case.

Liner 22 defines a cam-shaped inner surface 24 eccentric with respect to inside diameter 20 of case 12. Thus, cam-shaped inner surface 24 of line 22 has a minimum radius defining a stop portion 26 and a maximum radius portion 28. Liner 22 further defines a plurality of inlet ports 30 and a plurality of outlet ports 32 therein.

Referring now to FIG. 2, a pair of heads 34 are mounted to case 12 on opposite sides thereof. Each head 34 carries a bearing housing 36 concentric with inside diameter 20 of case 12. A shaft 38 extends longitudinally through pump 10. Shaft 38 is supported by a bearing 40 positioned in each bearing housing 36 for rotation within the pump. Referring again to FIGS. 1 and 2, a rotor 42 is fixedly attached to shaft 38 and rotatable therewith. Rotor 42 defines a substantially circular outside diameter 44. As can be seen in FIG. 1, outside diameter 44 is in close, spaced relationship to stop portion 26 of cam-shaped inner surface 24 of liner 22. Further, it can be seen that outside diameter 44 is spaced apart from maximum radius portion 28 of liner 22 so that a pumping chamber 46 is defined therebetween.

Rotor 42 defines a plurality of substantially radially oriented slots 48 therein which are preferably equally angularly spaced around the rotor. Each slot 48 has a radially inward surface 50 and a pair of opposite, substantially parallel, radial sides 52. Slidably disposed in each slot 48 is a blade or vane 54 of substantially parallelepiped configuration. Between rotor 42 and each head 34 is positioned a stationary sideplate 55 which limits longitudinal movement of rotor 42 and vanes 54.

Preferably, but not by way of limitation, there are an even number of slots 48 so that there are a plurality of oppositely disposed pairs of slots in rotor 42. In other words, in the preferred embodiment, each slot 48 has a corresponding slot angularly displaced 180° therefrom. In the configuration shown in FIG. 1, there are three pairs of such slots with six vanes.

Rotor 42 and shaft 38 define a plurality of holes therein extending radially inwardly from radially inward surface 50 of each slot 48. In the preferred embodiment, a hole interconnects each pair of opposite slots 48. In the six-vane configuration illustrated, three such holes 56, 58 and 60 are required. As seen in FIG. 2, holes 56, 58 and 60 are longitudinally spaced and do not intersect. Slidably positioned in each of holes 56, 58 and 60 is a vane actuator assembly 62.

Figure 3:
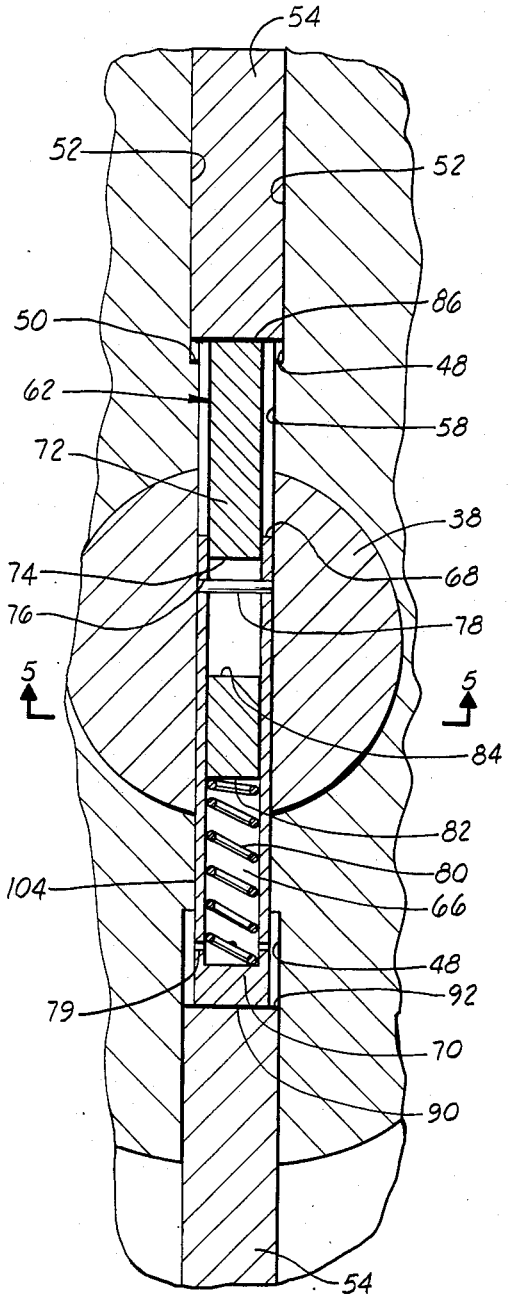
FIG. 3 shows an enlarged view of the vane actuating system as shown in FIG. 1.
Figure 4:
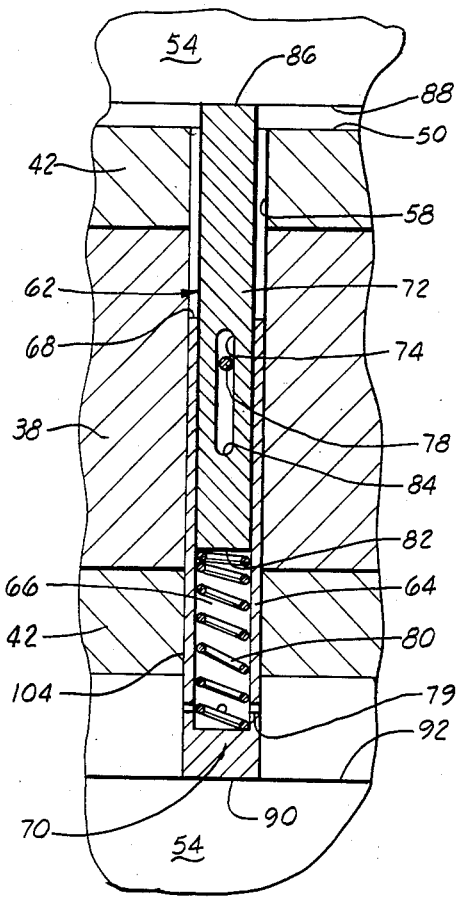
FIG. 4 is an enlarged longitudinal cross-sectional view of the vane actuating system as shown in FIG. 2.
Figure 5:
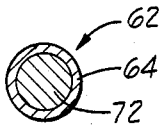
FIG. 5 is a transverse cross-section of the vane actuating system taken along line 5—5 in FIG. 3.

Referring to FIGS. 3–5, each vane actuator assembly 62 includes a first portion in the form of a substantially cylindrical sleeve 64 defining a substantially cylindrical cavity 66 therein with an open end 68 and a closed end 70. Reciprocably disposed in cavity 66, and dimensioned to closely fit therein, is a second portion in the form of a substantially cylindrical plunger 72. Plunger 72 defines a longitudinal slot 74 therethrough and sleeve 64 defines a transverse hole 76 therethrough corresponding to the slot in the plunger. A pin 78 is positioned in hole 76, extending through slot 74 in plunger 72. Pin 78 is preferably press-fit into hole 76, but fits loosely in slot 74 so that plunger 72 may freely reciprocate in cavity 66 of sleeve 64. In operation, fluid being pumped may eventually enter cavity 66 even though plunger 72 is dimensioned to closely fit in the cavity. However, because of these close tolerances, the fluid will not escape quickly from cavity 66 when plunger 72 is moved toward sleeve 64. If this situation occurs, the fluid may prevent plunger 72 from properly reciprocating in cavity 66. Therefore, sleeve 64 defines at least one fluid pressure relief hole 79 in communication with cavity 66 and adjacent closed end 70 of the sleeve so that fluid trapped in the cavity can escape quickly therefrom as plunger 72 is moved toward the closed end.

A spring 80 is positioned in cavity 64 so that it bears against closed end 70 of sleeve 64 and in inner end 82 of plunger 72. Preferably, spring 80 is always in compression so that it continuously acts as a biasing means to force plunger 72 and sleeve 64 apart. In a free position outside of pump 10, spring 80 will oppositely bias plunger 72 and sleeve 64 such that pin 78 bears against an end 84 of slot 74 which is nearest the spring, thus acting as a means for limiting total relative movement between the plunger and the sleeve. In this way, vane actuator assembly 62 forms a single unit which may be easily handled for installation in pump 10. Vane actuator assembly 62 is shown in an installed, working position in pump 10 in the drawing. Preferably, in the working position, sleeve 64 covers slot 74. Also, transverse hole 76 is positioned along sleeve 64 such that when vane actuator assembly 62 is in the working position, pin 78 is enclosed and contained by the corresponding hole 56, 58 or 60 such that it is impossible for pin 78 to work its way out of its corresponding transverse hole 76.

Still referring to FIGS. 3 and 4, it will be seen that outer end 86 of plunger 72 engages an inward surface 88 of a vane 54, and an outer edge 90 of closed end 70 of sleeve 64 engages a corresponding inward surface 92 of the opposite vane 54. Spring 80 insures that plunger 72 and sleeve 64 are maintained in such engagement.

Referring again to FIG. 1, case 12 includes an upper liner support 94 and a lower line support 96. Liner 22 is maintained in position by a key 97 attached to upper liner support 94 of case 12. Thus, an inlet chamber 98 and a separate outlet chamber 100 are defined by case 12 and liner 22. It will be seen by those skilled in the art that there is no communication between inlet chamber 98 and outlet chamber 100 around the outside of liner 22.

In operation, fluid enters pump 10 through inlet flange 14 into inlet cavity 98. The fluid then passes through inlet holes 30 and liner 22 where it is trapped between rotor 42, liner 22 and adjacent vanes 54. As shown in FIG. 1, rotor 42 rotates counterclockwise so that the fluid is moved through pumping chamber 46 and forced through outlet holes 32 in liner 22 into outlet chamber 100 for discharge from pump 10 through outlet flange 16. The close proximity of outside diameter 44 of rotor 42 and stop portion 26 of liner 22 allows comparatively little fluid to pass therebetween.

As rotor 42 turns, vanes 54 move along cam-shaped inner surface 24 of liner 22. As vanes 54 move from pumping chamber 46 to stop portion 26 adjacent discharge holes 32 in the liner, the vanes are forced inwardly. It will be obvious to those skilled in the art, that as vanes 54 move from stop portion 26 to pumping chamber 46 adjacent inlet holes 30 in liner 22, the vanes must move outwardly for effective pumping. Vane actuator assemblies 62 help accomplish this by transferring the force from each inwardly moving vane 54 to the corresponding opposite vane. As already indicated, spring 80 is preferably sized such that vane actuator assembly 62 is always engaged with both opposite vanes 54. Thus, as any vane 54 slides inwardly, the respective vane actuator assembly is forced to slide in the corresponding hole 56, 58 or 60, thus forcing the opposite vane 54 outwardly against cam-shaped surface 24 of liner 22.

Unlike the solid pin of the prior art, vane actuator assembly 62 also compensates for variations in movement of vanes 54 as they are moved along inner surface 24 by rotor 42 and also compensates for eventual wear of outer edges 102 of the vanes. Unlike spring actuators of the prior art, spring 80 is totally enclosed in vane actuator assembly 62 and is thus subjected to no sliding wear on its outer surfaces as the vane actuator moves in the hole. It has been found that sleeve 64 and plunger 62 may be made of lightweight plastic which results in minimal wear on the outer diameter 104 of the sleeve as it reciprocates in hole 56, 58 or 60. This light weight also reduces the momentum transferred to inward surfaces 88 and 90 of vanes 54. The result is a sliding vane positive displacement pump with vane actuating system which has minimal wear problems on the vane actuating assembly and on the vanes themselves. Further, because the vane actuating system compensates for wear, vanes 54 are maintained in better contact with inner surface 24 of cam throughout the life of the pump, thus resulting in better operation over extended periods.

It can be seen, therefore, that the pump with the vane actuating system of the present invention is well adapted to carry out the objects and attain the ends and advantages mentioned, as well as those inherent therein. While a presently preferred embodiment of the invention has been described for the purposes of this disclosure, numerous changes in the construction and arrangement of the parts can be made by those skilled in the art. All such changes are encompassed within the scope and spirit of this invention as defined by the appended claims.

What is claimed is:

1. A vane actuating apparatus for a radially slidable vane in a positive displacement pump, said vane actuating apparatus comprising:

a first portion defining a cavity therein;

a second portion having an end reciprocably disposed in said cavity, one of said first and second portions defining a longitudinal slot therein, and the other of said first and second portions defining a transversely disposed hole therein, said slot corresponding to said hole;

biasing means contained within said cavity and disposed between said first and second portions for oppositely biasing said first and second portions; and means limiting relative movement between said first and second portions comprising a pin disposable in said hole and extending into said slot;

whereby, at least one of said portions may be placed in contact with said vane for radially outwardly biasing said vane when in an operating position within said pump.

2. The apparatus of claim 1 wherein said second portion covers said slot when in said operating position.

3. In a pump of the type having a case, a rotor concentric with said case and rotatable therein, said rotor defining at least a pair of oppositely disposed slots, each slot having a vane slidably disposed therein, the improvement comprising:

said rotor defining a hole therethrough in communication with said slots; and a vane actuator assembly positioned in said hole for outwardly actuating one of said vanes as the other of said vanes moves inwardly, said vane actuator assembly comprising:

a first portion having an outwardly directed end engageable with one of said vanes;

a second portion having an outwardly directed end engageable with the other of said vanes, one of said portions defining a cavity therein with an open end for slidably receiving the other of said portions, and one of said portions defining a slot therein and the other of said portions defining a transverse hole therein corresponding to said longitudinal slot;

a spring disposed in said cavity for oppositely biasing said portions toward said vanes for engagement therewith; and means limiting total relative movement between said first and second portions comprising a pin positioned in said transverse hole and extending into said slot.

4. The apparatus of claim 3 wherein said portion defining said transverse hole covers said slot when said vane actuator assembly is in an operating position in said pump.

5. A pump comprising:

a housing having an inlet and an outlet;

a liner having a cam-shaped inner surface eccentrically disposed within said housing;

a rotor having a plurality of substantially radially disposed slots therein, said rotor being concentric with said housing and rotatable with respect thereto, having an outside diametric surface in close, spaced relationship to a portion of said inner surface, and defining a radially oriented hole in communication with an inward surface of each of said slots;

a vane slidably disposed in each of said slots having an outer edge engageable with said cam-shaped inner surface of said liner and an inner edge; and a vane actuator assembly disposed in each of said holes, each of said vane actuator assemblies comprising:

a hollow sleeve defining an open end and a closed end and further defining a transverse hole therethrough;

a plunger slidably disposed in said sleeve and defining a longitudinal slot therethrough corresponding to said hole in said sleeve;

a spring disposed in said sleeve and bearing against an end of said plunger and said closed end of said sleeve for oppositely biasing said sleeve and said plunger; and means limiting relative movement between said sleeve and plunger comprising a pin positioned in said transverse hole and extending through, and slidable with, said slot;

whereby, when said vane actuator assemblies are in an operating position in said holes in said rotor, at least one of said closed ends of said sleeve and an end of said plunger opposite said first-mentioned end thereof is engageable with an inward edge of a vane such that said vane is outwardly biased toward said cam-shaped inner surface of said liner as said rotor rotates within said case.

6. The apparatus of claim 5 wherein said sleeve covers said slot in said plunger when said vane actuator assembly is positioned in said hole in said rotor adjacent said vane.

7. A sliding vane pump comprising:

a case defining a longitudinal axis therethrough and having an inlet and and outlet;

a liner having a cam-shaped inner surface in eccentric relationship withh said case;

a rotor having a plurality of substantially radially disposed slots therein, said slots being substantially equally angularly spaced such that each slot has a corresponding opposite slot, said rotor being concentric with said case and rotatable therewith on said longitudinal axis, having an outside diametric surface in close, spaced relationship to a portion of said cam-shaped inner surface, and further defining a radially oriented hole therethrough in communication with each pair of opposite slots;

a plurality of vanes, each vane being slidably positioned in one of said slots and having an outer edge engageable with said cam-shaped inner surface of said liner and an inner edge;

a vane actuator assembly disposed in each of said holes, each vane actuator assembly comprising:

a hollow sleeve defining a closed end engaged with said inner edge of one of said vanes and an open end, said sleeve further defining a transverse hole therethrough;

a plunger having a first end reciprocably disposed in said sleeve and a second end opposite said first end, said second end being engaged with said inner surface of a vane positioned opposite said vane engaged with said closed end of said sleeve, said plunger further defining a slot therethrough corresponding to said hole in said sleeve;

a spring disposed in said sleeve and bearing against said first end of said plunger and an inner surface of said closed end of said sleeve for oppositely biasing said sleeve and said plunger; and means limiting relative movement between said sleeve and plunger and comprising a pin disposed in said transverse hole and exending through said slot and slidable with said slot;

whereby, when each of said vane actuator assemblies is placed in an operating position in the corresponding hole in said rotor, said spring disposed therein maintains said second end of said plunger and said closed end of said sleeve in contact with said respective vanes, such that said vanes are maintained in contact with said cam-shaped inner surface of said liner as said rotor rotates within said case.

8. The apparatus of claim 7 wherein each of said sleeve covers said corresponding slot when said vane actuator assemblies are in said operating position.

* * * * *